US008960875B2

(12) United States Patent
Shiba et al.

(10) Patent No.: US 8,960,875 B2
(45) Date of Patent: Feb. 24, 2015

(54) INSERT METHOD OF NEGATIVE-PRESSURE GENERATING MEMBER AND INSERT DEVICE OF NEGATIVE-PRESSURE GENERATING MEMBER

(75) Inventors: Akira Shiba, Machida (JP); Isamu Yoneda, Kawasaki (JP); Ryota Yamada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 13/401,609

(22) Filed: Feb. 21, 2012

(65) Prior Publication Data

US 2012/0227861 A1 Sep. 13, 2012

(30) Foreign Application Priority Data

Mar. 11, 2011 (JP) ..... 2011-054282

(51) Int. Cl.
*B41J 2/175* (2006.01)

(52) U.S. Cl.
CPC ..... *B41J 2/17559* (2013.01); *B41J 2/17513* (2013.01)
USPC ..... 347/93

(58) Field of Classification Search
CPC ..... B41J 2/17533; B41J 2/17559; B41J 2/175
USPC ..... 347/86, 87, 93; 53/245, 249, 246, 253, 53/255, 263
See application file for complete search history.

(56) References Cited

U.S. PATENT DOCUMENTS

| | | | | |
|---|---|---|---|---|
| 5,615,536 | A * | 4/1997 | Tanaka | 53/447 |
| 5,642,603 | A | 7/1997 | Tanaka | 53/445 |
| 5,875,615 | A | 3/1999 | Ito et al. | 53/474 |
| 6,058,984 | A | 5/2000 | Sato | 141/7 |
| 6,250,746 | B1 * | 6/2001 | Ito et al. | 347/86 |
| 6,390,616 | B2 * | 5/2002 | Shinada et al. | 347/86 |
| 6,394,591 | B1 * | 5/2002 | Higuma et al. | 347/86 |

(Continued)

FOREIGN PATENT DOCUMENTS

| | | |
|---|---|---|
| CN | 1192405 | 9/1998 |
| CN | 1242301 | 1/2000 |

(Continued)

OTHER PUBLICATIONS

Chinese Office Action dated Mar. 31, 2014 in counterpart Chinese Patent Application No. 201210059626.0, and English translation.

(Continued)

*Primary Examiner* — Matthew Luu
*Assistant Examiner* — Patrick J. King
(74) *Attorney, Agent, or Firm* — Fitzpatrick, Cella, Harper & Scinto

(57) ABSTRACT

There is provided an insert method of a negative-pressure generating member where, upon inserting a negative-pressure generating member 130 into a negative-pressure generating member accommodating chamber, the negative-pressure generating member 130 is inserted while being rotated to a predetermined rotation angle, is inserted to the bottom portion in the negative-pressure generating member accommodating chamber while retaining the rotated angle, and further, is inserted by rotating the negative-pressure member 130 in a reverse direction to the previous rotation direction, thereby increasing a density of the negative-pressure generating member in the partition wall adjacent section.

9 Claims, 7 Drawing Sheets

(56) References Cited

U.S. PATENT DOCUMENTS

| | | | | |
|---|---|---|---|---|
| 6,523,579 | B1 * | 2/2003 | Tham | 141/34 |
| 6,758,557 | B2 * | 7/2004 | Udagawa et al. | 347/86 |
| 6,874,875 | B1 * | 4/2005 | Anderson et al. | 347/86 |
| 7,213,386 | B2 * | 5/2007 | Hooper | 53/448 |
| 7,302,785 | B2 | 12/2007 | Heuvel et al. | 53/445 |
| 7,445,322 | B2 * | 11/2008 | Kitabatake et al. | 347/86 |
| 7,997,707 | B2 | 8/2011 | Shimizu et al. | 347/87 |
| 2001/0026305 | A1 * | 10/2001 | Shinada et al. | 347/86 |
| 2002/0021339 | A1 * | 2/2002 | Higuma et al. | 347/86 |
| 2002/0167570 | A1 | 11/2002 | Udagawa et al. | 347/85 |
| 2003/0020790 | A1 * | 1/2003 | Kotaki et al. | 347/86 |
| 2003/0071881 | A1 | 4/2003 | Toba et al. | 347/86 |
| 2003/0126834 | A1 * | 7/2003 | Chapin et al. | 53/255 |
| 2005/0030356 | A1 * | 2/2005 | Toba et al. | 347/86 |
| 2006/0007286 | A1 * | 1/2006 | Ogawa et al. | 347/87 |
| 2006/0221154 | A1 * | 10/2006 | Takatsuka | 347/86 |
| 2007/0070135 | A1 * | 3/2007 | Myers et al. | 347/86 |
| 2009/0141099 | A1 * | 6/2009 | Tsukamoto | 347/86 |
| 2010/0011577 | A1 | 1/2010 | Yoneda | 29/890.1 |
| 2011/0209335 | A1 | 9/2011 | Yamamoto et al. | 29/505 |
| 2013/0247523 | A1 * | 9/2013 | Wilke et al. | 53/473 |

FOREIGN PATENT DOCUMENTS

| | | |
|---|---|---|
| CN | 2571588 | 9/2003 |
| JP | 08-090783 (H) | 4/1996 |
| JP | 11-048490 | 2/1999 |
| JP | 2001-212977 | 8/2001 |
| JP | 2002-225308 | 8/2002 |
| JP | 2003-089220 | 3/2003 |

OTHER PUBLICATIONS

U.S. Appl. No. 13/401,616, filed Feb. 21, 2012.

* cited by examiner

INSERT METHOD OF NEGATIVE-PRESSURE GENERATING MEMBER AND INSERT DEVICE OF NEGATIVE-PRESSURE GENERATING MEMBER

BACKGROUND OF THE INVENTION

1. Field of the Invention

This invention relates to an insert method and an insert device of a negative-pressure generating member in a liquid accommodating container of a liquid ejecting device.

2. Description of the Related Art

A liquid ejecting device for ejecting a liquid is generally provided with a supply system for supplying a liquid such as ink to a liquid ejecting head, and a liquid accommodating container removably connected to the upstream side of the supply system for retaining the liquid. In regard to a quality required of the liquid accommodating container, a state where a volume of air bubbles existing in the liquid accommodating chamber in the liquid accommodating container is small is defined as a high quality. Because the air bubble existing in the liquid accommodating chamber expands due to a temperature rise or an atmospheric reduction. The liquid corresponding to an amount of the expanded volume flows into a negative-pressure generating member accommodating chamber in the liquid accommodating container from the liquid accommodating chamber, and the flown liquid is absorbed by a negative-pressure generating member therein. However, when the pressure in the negative-pressure generating member accommodating chamber exceeds a liquid retaining force of the negative-pressure generating member, a liquid leakage occurs from a liquid supply port. Therefore, in liquid filling of the liquid accommodating container, a volume management of the air bubbles existing in the liquid accommodating chamber results in having a great impact on a quality of the liquid accommodating container. In the manufacture of the liquid accommodating container, the insert of the negative-pressure generating member is performed by using a method described in Japanese Patent Laid-Open No. 2002-225308, and the liquid filling is performed by using a filling method described in Japanese Patent Laid-Open No. H11-48490 (1999).

However, the following problem occurs in a case of performing the liquid filling by using the technique described in Japanese Patent Laid-Open No. H11-48490 (1999) described above. That is, there are some cases the liquid permeates into the negative-pressure generating member in a state where air and the liquid are mixed in the negative-pressure generating member at the wall adjacent portion having an atmospheric introduction groove. It is known that this phenomenon occurs at an atmospheric release time in the liquid filling process. Due to the phenomenon of aspiring air into the liquid accommodating chamber at such an atmospheric release time, there are some cases where the air more than estimated is taken into the liquid accommodating chamber, and as a result, the quality as the liquid accommodating container can not be satisfied.

Even in a case where the air is not aspired into the liquid accommodating chamber at the atmospheric release time, there occurs a state where the air and the liquid are mixed in the negative-pressure generating member at the wall adjacent portion, creating a state where the air is likely to more easily pass through. When an impact is imposed on the liquid accommodating container in this state, an air-liquid conversion occurs due to the likelihood of filling a space where the air and the liquid are mixed in the wall adjacent portion with the liquid in the liquid accommodating chamber, and the air in the liquid accommodating chamber resultantly increases, thus bringing in the difficulty of satisfying the quality.

In the liquid filling method described in Japanese Patent Laid-Open No. H11-48490 (1999), for preventing the state where the air and the liquid are mixed from occurring in the negative-pressure generating member at the wall adjacent portion, two preventive methods are considered. The first is a method where, by sparing more time for atmosphere releasing, a liquid pushing force by the atmosphere at the atmospheric release time is weakened to slow down a liquid flowing speed into the liquid accommodating chamber, and thereby the liquid is supplied from the entire negative-pressure generating member into the liquid accommodating chamber. In this method, however, it is required to spare more than several ten seconds as the time for the atmosphere releasing, which therefore raises a problem with productivity. The second is a method where a density of the negative-pressure generating member at the wall adjacent portion is increased by tightly contacting the negative-pressure generating member with the wall having the atmospheric introduction groove, thus increasing a flow resistance. When the flow resistance of the wall adjacent portion is larger, the liquid flowing speed into the liquid accommodating chamber can be the slower, so that the liquid can be supplied from the entire negative-pressure generating member into the liquid accommodating chamber. However, in the conventional insert method of the negative-pressure generating member, it is difficult to insert the negative-pressure generating member in a state where the density of the negative-pressure generating member at the wall adjacent portion is more positively increased as compared to that of the other section.

SUMMARY OF THE INVENTION

Accordingly, an object of the present invention is to provide an insert method of a negative-pressure generating member, which can increase a density of the negative-pressure generating member at a wall adjacent portion.

Therefore, an insert method in the present invention is provided with an insert method where a liquid accommodating container includes a partition wall in which a communication section between a negative-pressure generating member accommodating chamber and a liquid accommodating chamber and an atmospheric introduction groove for introducing air into the liquid accommodating chamber are formed, and the negative-pressure generating member accommodating chamber and the liquid accommodating chamber partitioned and formed by the partition wall, wherein a negative-pressure generating member is inserted into the negative-pressure generating member accommodating chamber in the liquid accommodating container, the negative-pressure generating member being formed as matched in shape to the negative-pressure generating member accommodating chamber and as having a size larger than an inner dimension thereof in the perpendicular direction to the partition wall, comprising a first rotation step of, upon inserting the negative-pressure generating member into the negative-pressure generating member accommodating chamber by using a front end of a surface of the negative-pressure generating member making contact with a support member provided on the surface opposing the partition wall at the inserting as a supporting point, rotating the negative-pressure generating member by a predetermined angle in such a manner that a first surface of the negative-pressure generating member making contact with the partition wall is inserted into the negative-pressure generating member accommodating chamber, a first insert step of inserting the negative-pressure generating member into the negative-pressure generating member accommodating chamber while retaining the rotated angle in the first rotation step, a second rotation step of, in a state where the negative-pressure generating member is inserted in the insert step, rotating the negative-pressure generating member by the same angle with that in the first step in a reverse direction to the direction in the first rotation step by using a rear end of the first surface of the negative-pressure generating member making contact with an end of the partition wall at the inserting as a supporting point, and a second insert step of contacting a front surface of the negative-pressure generating member in the insert direction after the second rotation step with a bottom surface of the negative-pressure generating member accommodating chamber.

Further features of the present invention will become apparent from the following description of exemplary embodiments (with reference to the attached drawings).

DESCRIPTION OF THE EMBODIMENTS

Hereinafter, embodiments according to the present invention will be described with reference to the accompanying drawings, and first, the construction of a general liquid accommodating container will be explained.

Figure 7:
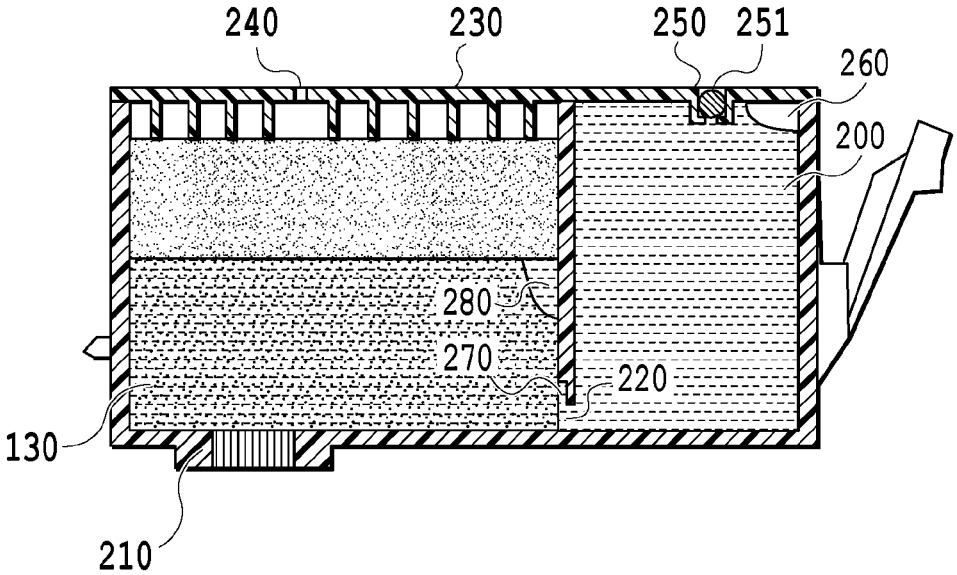
FIG. 7 is a diagram showing a general liquid accommodating container.

FIG. 7 is a diagram showing a general liquid accommodating container. The liquid accommodating container is provided with a liquid supply portion 210 for supplying a liquid such as ink from the liquid accommodating container to an outside. Further, in the liquid accommodating container, a recessed portion of a negative-pressure generating member accommodating chamber for accommodating a negative-pressure generating member and a recessed portion of a liquid accommodating chamber are molded integrally with a partition wall provided with a communication portion 220 and an atmospheric introduction groove 270. In addition, an upper portion of the liquid accommodating container is covered with a common cover member 230 as an upper wall. A section of the cover member 230 corresponding to the negative-pressure generating member accommodating chamber is provided with an atmospheric communication portion 240 for performing air introduction into the container following liquid consumption and a section of the cover member 230 corresponding to the liquid accommodating chamber is provided with a liquid filling hole 250.

Upon filling the liquid accommodating container of such a construction with the liquid, when a pressure reducing state in the liquid accommodating container is opened to an atmosphere through the atmospheric communication portion, the filled liquid is pressed in a direction opposing the cover member 230 as a whole by an atmospheric pressure. In regard to the pressed liquid, the liquid absorbed in the negative-pressure generating member 130 first flows into the liquid accommodating chamber from the section adjacent to the communication portion 220 and the liquid gathers in the section adjacent to the communication portion 220 from the entire negative-pressure generating member for compensating for the reduced liquid. In a case where the density of the negative-pressure generating member 130 in the wall adjacent section at this time is not appropriate, the flow resistance in the wall adjacent section is made small and the flowing speed of the liquid into the liquid accommodating chamber becomes fast. It is found out that when the flowing speed of the liquid is fast, air flows into the liquid accommodating chamber from the atmospheric communication portion other than the flow into the liquid accommodating chamber from the entire negative-pressure generating member, creating a state where the liquid and the air are mixed in the negative-pressure generating member in the wall adjacent section.

Figure 1A:
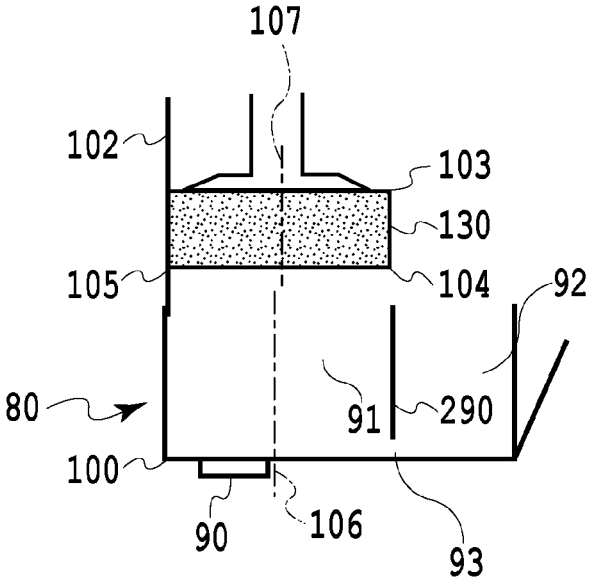
FIG. 1A is a schematic diagram showing an insert method of a negative-pressure generating member in a liquid accommodating container.
Figure 1B:
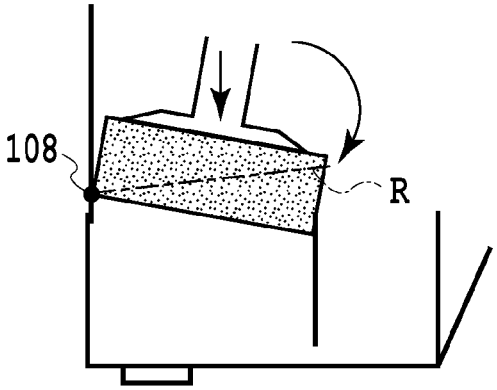
FIG. 1B is a schematic diagram showing the insert method of the negative-pressure generating member in the liquid accommodating container.
Figure 1C:
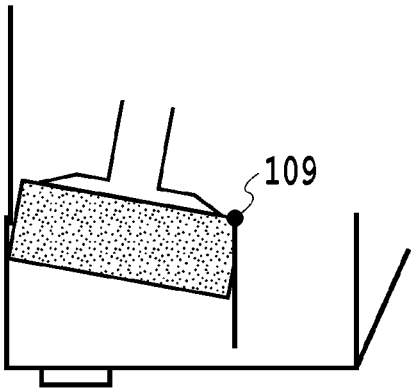
FIG. 1C is a schematic diagram showing the insert method of the negative-pressure generating member in the liquid accommodating container.
Figure 1D:
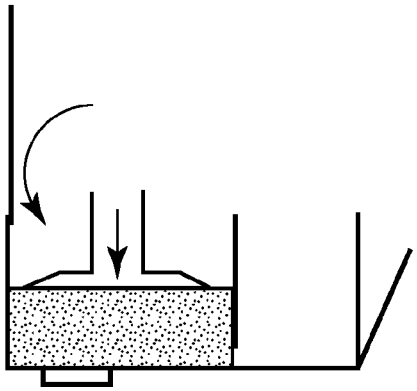
FIG. 1D is a schematic diagram showing the insert method of the negative-pressure generating member in the liquid accommodating container.
Figure 2:
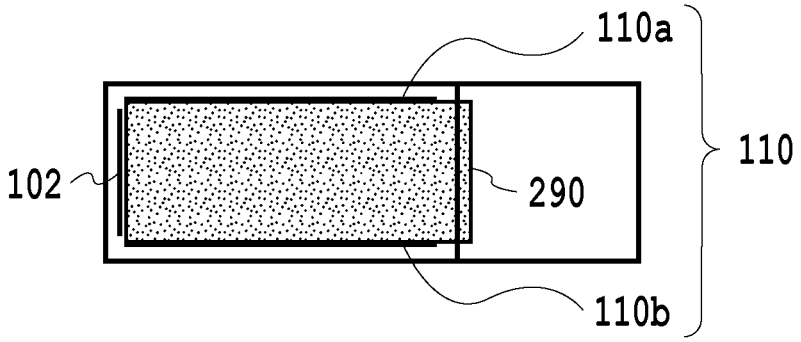
FIG. 2 is a plan view showing a state of inserting the negative-pressure generating member into the liquid accommodating container.

FIG. 1A to FIG. 1D are schematic diagrams showing an insert method of a negative-pressure generating member in a liquid accommodating container 80 to which the present invention is applied, and FIG. 2 is a plan view showing a state of inserting the negative-pressure generating member 130 into the liquid accommodating container 80. Upon inserting the negative-pressure generating member 130 into the liquid accommodating container 80, a container body 100 formed integrally with a partition wall 290 provided with a communication portion 93 through which a recessed portion 91 in a negative-pressure generating accommodating chamber and a recessed portion 92 in a liquid accommodating chamber are communicated and an atmospheric introduction groove (not shown) is fixed by a fixing member. In addition, a negative-pressure generating member introduction guide 102 is arranged in the vicinity of a surface (hereinafter, called a short surface) of the recessed portion 91 opposing the partition wall 290 in the negative-pressure generating member accommodating chamber in the container body 100. Further, a compression member 110 for compressing the negative-pressure generating member 130 is arranged in the vicinity of a surface (hereinafter, called a long surface) of the recessed portion 91 perpendicular to the partition wall 290 in the negative-pressure generating member accommodating chamber.

The negative-pressure generating member 130 sized to be larger than an inside dimension of the recessed portion 91 in the negative-pressure generating member accommodating chamber is compressed to a dimension smaller than the inside dimension of the recessed portion 91 from the long surface by the compression member 110. After that, the short surface of the compressed negative-pressure generating member 130 is made to be in contact with the negative-pressure generating member introduction guide 102. At this time, an upper surface of the negative-pressure generating member 130 is in parallel with the bottom surface of the recessed portion 91 and, as shown in FIG. 1A, a center 107 of the long surface of the negative-pressure generating member 130 is arranged (a position is determined) in a state of being closer to the side of the liquid accommodating chamber by several millimeters than a center 106 of the long surface of the negative-pressure generating member accommodating chamber.

Next, a negative-pressure generating member insert member (hereinafter, simply called an insert member or a rotation insert member) 101 is made to be in contact with the upper surface of the negative-pressure generating member 130. As shown in FIG. 1B, a lower side ridge 105 of the negative-pressure generating member 130 in the side of the short surface (ridge of the front end at inserting) is made as a rotation support point 108 to rotate the negative-pressure generating member 130 such that the partition wall side of the pressed surface of the negative-pressure generating member 130 is lowered on a basis of the rotation support point (first rotation). A rotation angle at this time differs depending on a dimension of the negative-pressure generating member 130, and is preferably in the vicinity of an angle in which a diagonal line R of the long surface is in parallel with the bottom surface of the recessed portion 91. At the time of thus rotating and inserting the negative-pressure generating member 130, the surface (first surface) of the negative-pressure generating member 130 making contact with the partition wall 290 is entered into the inside of the recessed portion 91, and the negative-pressure generating member 130 moves until an upper side ridge 103 of the negative-pressure generating member makes contact with an upper portion of the partition wall 290. Thereafter, the rotation angle of the insert member 130 is maintained, while the insert member 130 is inserted downward in the perpendicular direction to the bottom surface of the negative-pressure generating member accommodating chamber until the ridge 103 of the negative-pressure generating member 130 enters into the recessed portion 91 (first insert).

Figure 3:
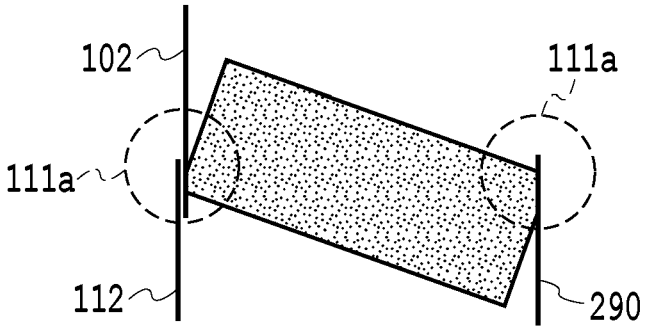
FIG. 3 is a diagram showing the process of inserting the negative-pressure generating member into a recessed portion in a negative-pressure generating member accommodating chamber.
Figures 4A, 4B:
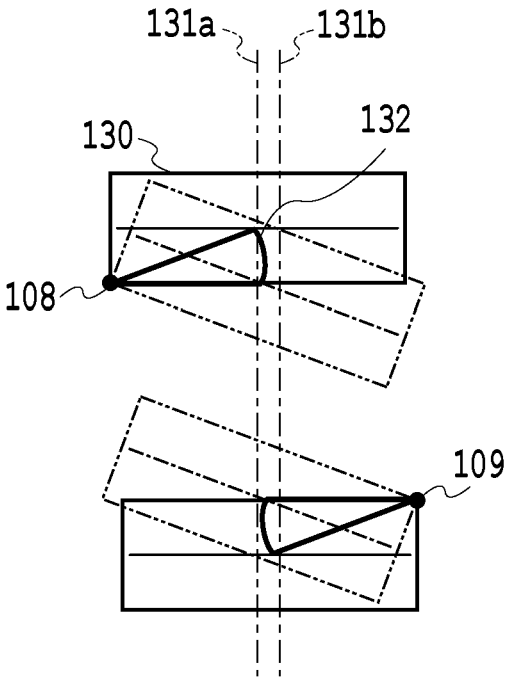
FIG. 4A is a diagram showing a behavior of the negative-pressure generating member at the time of inserting the negative-pressure generating member into the recessed portion.
FIG. 4B is a diagram showing a behavior of the negative-pressure generating member at the time of inserting the negative-pressure generating member into the recessed portion.

FIG. 3 is a diagram showing the process of inserting the negative-pressure generating member 130 into the recessed portion 91 in the negative-pressure generating member accommodating chamber, and FIG. 4A and FIG. 4B are diagram showing a behavior of the negative-pressure generating member 130 at the time of inserting the negative-pressure generating member 130 into the recessed portion 91 in the negative-pressure generating member accommodating chamber. In a state of FIG. 3, the ridges 103 and 105 of the negative-pressure generating member 130 are compressed to force the compression sections 111*a* and 111*b* to be in a compressed state. After the compression sections 111*a* and 111*b* are compressed, a section of the upper surface of the negative-pressure generating member 130 making contact with the partition wall 290 (rear end of the surface (first surface) of the negative-pressure generating member 130 in the insert direction) is made as a support point to rotate the negative-pressure generating member 130. Thereupon, the negative-pressure generating member 130 is rotated (second rotation) at the same angle in a reverse direction to the previous rotation direction such that the upper surface of the negative-pressure generating member 130 is in parallel with the bottom surface of the recessed portion 91 in the negative-pressure generating member accommodating chamber. After that, the negative-pressure generating member 130 is inserted (second insert) perpendicularly until a front surface of the negative-pressure generating member 130 in the insert direction reaches a desired position of the recessed portion 91 in the negative-pressure generating member accommodating chamber.

In this manner, the rotation support point 108 is used as the support point to rotate the negative-pressure generating member in the first rotation step, and, after that, the rotation support point 109 is used as the support point to perform the second rotation. Then, the center point of the negative-pressure generating member moves along a trace 132 as shown in the figure to force the negative-pressure generating member 130 to be in a compressed state in the side of the partition wall 290 thereof. The center of the negative-pressure generating member 130 resultantly moves from a center line 131*a* to a center line 131*b* with the rotation movement, and the negative-pressure generating member 130 can be inserted with intent to being compressed in the side of the partition wall 290.

After inserting the negative-pressure generating member 130, a high compression state of the negative-pressure generating member 130 in the side of the partition wall 290 is maintained by a frictional force between a peripheral wall inner surface forming the recessed portion 91 in the negative-pressure generating member accommodating chamber and the negative-pressure generating member 130. That is, between the peripheral wall inner surface and the negative-pressure generating member 130, there occurs a state of producing the frictional force capable of sufficiently maintaining the high compression state of the negative-pressure generating member 130.

Figure 5A:
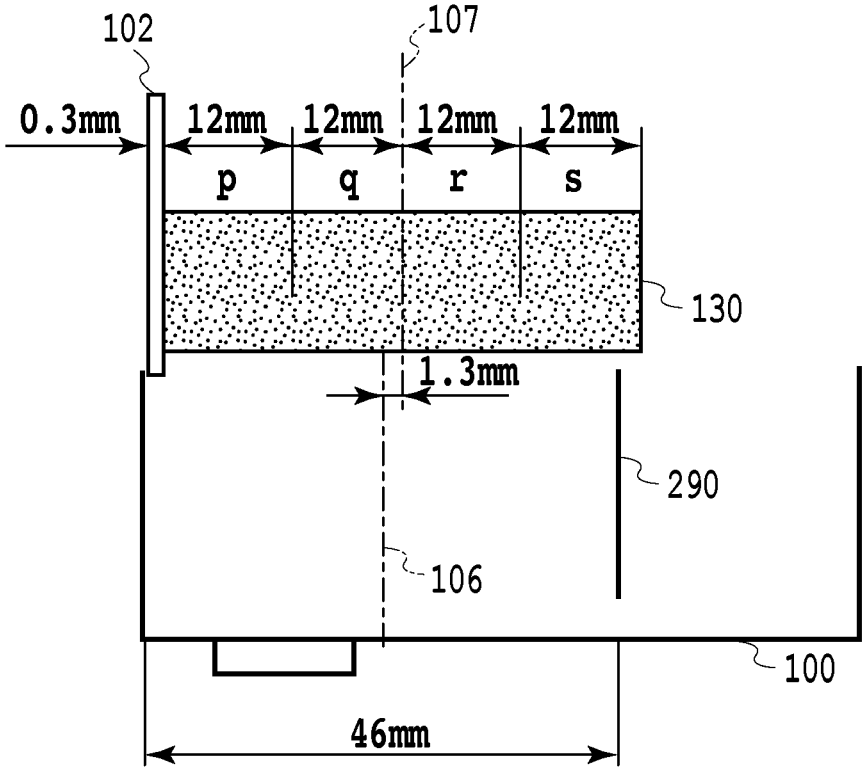
FIG. 5A is a diagram showing a state before inserting the negative-pressure generating member.
Figure 5B:
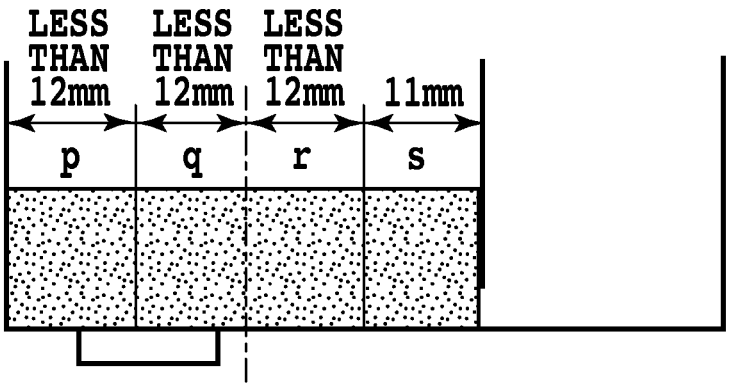
FIG. 5B is a diagram showing a state after inserting the negative-pressure generating member.

FIG. 5A is a diagram showing a state before inserting the negative-pressure generating member 130 into the negative-pressure generating member accommodating chamber, and FIG. 5B is a diagram showing a state after inserting the negative-pressure generating member 130 into the negative-pressure generating member accommodating chamber. According to experiments, as shown in FIG. 5A, the negative-pressure generating member 130, the long surface of which is equally divided into four blocks of block p to block s each having 12 mm, is inserted into the negative-pressure generating member accommodating chamber smaller by 2 mm than an entire length of the long surface of the negative-pressure generating member 130 by the insert method according to the present embodiment. As a result, the negative-pressure generating member 130 is, as shown in FIG. 5B, inserted such that each block section of block p, block q, and block r is compressed into a dimension slightly shorter than 12 mm and a section of block s is compressed into a dimension of 11 mm. In this manner, when a compression rate of the negative-pressure generating member 130 closer to the partition wall 290 is increased, a tight contact of the negative-pressure generating member 130 with the partition wall 290 can be increased. It should be noted that the aforementioned negative-pressure generating member introduction guide 102 can change the tight contact state of the negative-pressure generating member closer to the partition wall by changing the thickness and an advance amount thereof into a depth of the negative-pressure generating member accommodating recessed portion.

In this manner, upon inserting the negative-pressure generating member 130 into the negative-pressure generating member accommodating chamber, the negative-pressure generating member 130 is inserted while being rotated until a predetermined rotation angle, inserted to the bottom portion in the negative-pressure generating member accommodating chamber while maintaining the rotation angle, and further, inserted by rotating the negative-pressure generating member 130 in a reverse direction to the previous rotation direction. In consequence, the density in the wall adjacent section of the negative-pressure generating member 130 can be increased for the inserting.

Next, the construction of the insert device for implementing the insert of the negative-pressure generating member 130 according to the present invention will be explained below.

Figure 6:
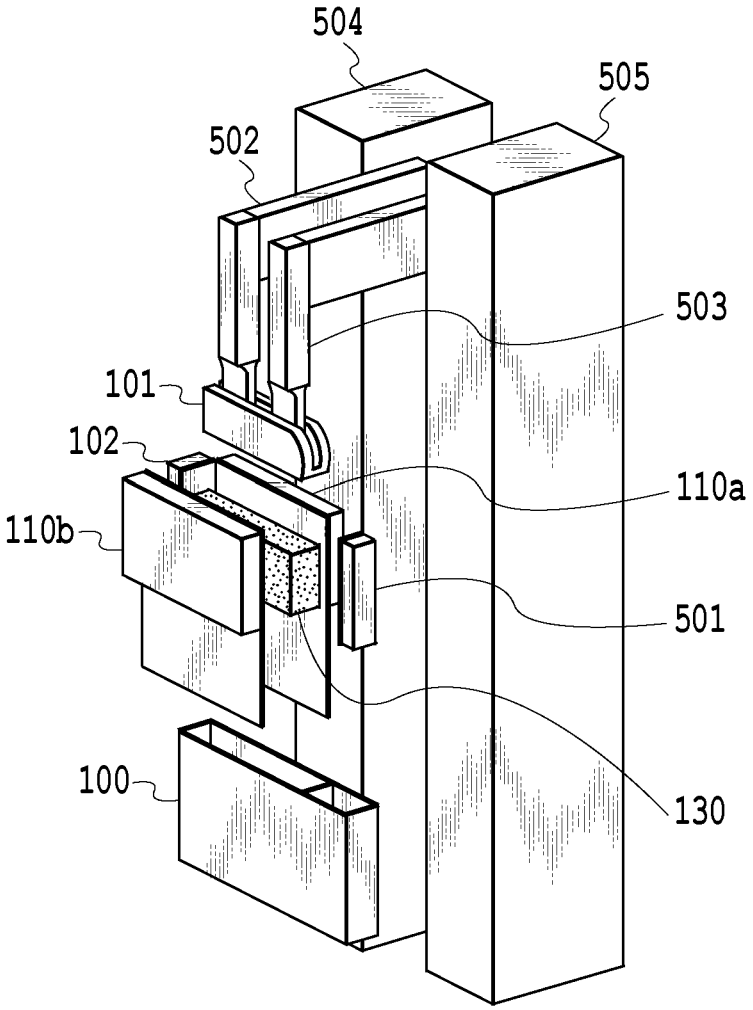
FIG. 6 is a diagram showing an example of a negative-pressure generating member insert device.

FIG. 6 is a diagram showing an example of the negative-pressure generating member insert device. Compression members 110*a* and 110*b* for compressing the negative-pressure generating member are arranged in the long surface sides of the negative-pressure generating member 130, and the negative-pressure generating member introduction guide (hereinafter, simply called an introduction guide) 102 is arranged in the short surface side of the negative-pressure generating member 130. A positioning mechanism 501 is arranged in a position opposing the short surface of the negative-pressure generating member. The compression member 110*a*, the introduction guide (support member) 102, and the positioning mechanism 501 are arranged on the same Z axis drive unit, wherein a position thereof in the Z axis direction can be changed in a preparation stage of compressing and positioning the negative-pressure generating member 130 and in a insert stage of inserting the negative-pressure generating member 130. The compression member 110*a* and the introduction guide 102 are fixed on the Z axis drive unit. The compression member 110*b* uses a drive unit such as a cylinder to perform a main compression in an advance point, a preliminary compression in an intermediate point, and a release operation in a retreat point.

It should be noted that an interval between the compression members 110*a* and 110*b* in the release state is larger than a dimension of the negative-pressure generating member 130 in a non-compression state, and the interval therebetween in the preliminary compression state is decreased to be in the compressed state to the extent that the negative-pressure generating member 130 can be retained. Therefore, a series of operations of the supply, the preliminary compression (retaining), and the main compression of the negative-pressure generating member 130 can be smoothly performed.

After the performing the main compression of the negative-pressure generating member 130, the negative-pressure generating member 130 is moved to the introduction guide by the positioning member having the drive unit such as a cylinder to be positioned in a desired position. At this time, the advance position of the positioning member is disposed considering that an interval between the positioning member and the introduction guide 102 in the opposing position is formed to a size equivalent to that of the negative-pressure generating member 130 not to deform the negative-pressure generating member 130. After compressing and positioning the negative-pressure generating member 130, the compression member 110*a* and the introduction guide 102 are lowered to insert the introduction guide 102 into the recessed portion 91 of the negative-pressure generating member accommodating chamber in the liquid container. Each of the compression members 110*a* and 110*b* may have an upper portion having a sufficient strength to be used as a compression section, and a lower portion formed of a thin plate of about 0.5 mm to be used as an introduction member in the long surface side. In this manner, the insert process goes through the preparation stage of the compression and the positioning of the negative-pressure generating member 130, and goes to the insert stage.

The insert member 101 has the Z axis drive unit and a mechanism for changing an angle of the pressing surface of the negative-pressure generating member 130, and when the angle of the pressing surface is changed in the process of inserting the negative-pressure generating member 130 into the negative-pressure generating member accommodating chamber, the negative-pressure generating member 130 can be rotated to a desired angle. The insert member 101 is, as shown in FIG. 6, is coupled to an insert shaft 502 and an insert shaft 503. A hole of the insert member 101 in the side of the insert shaft 502 is formed as a long hole and a hole thereof in the side of the insert shaft 503 is formed as a round hole, and a shaft is inserted into the holes of the insert member 101 and the holes of the respective insert shafts to couple the insert member 101 to the insert shafts 502 and 503. Z axis motors 504 and 505 are coupled respectively to the insert shafts, which can be individually driven. At the time of horizontally moving the pressing surface of the insert member 101, both of the insert shafts are moved at the same speed, and at the time of rotating it, only one of the insert shafts is moved or the two shafts are moved with a difference in speed therebetween, thus making it possible to insert the negative-pressure generating member at a desired rotation angle. After inserting the negative-pressure generating member 130 to a desired position by the insert member 101, the introduction guide 102 and the insert member 101 are retreated in that order from the negative-pressure generating member accommodating chamber. With the insert device for the negative-pressure generating member 130, which is capable of controlling a series of the operations in these mechanisms by the control device, the insert method of the negative-pressure generating member 130 in the present embodiment can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-054282, filed Mar. 11, 2011, which is hereby incorporated by reference herein in its entirety.

What is claimed is:

1. An insert method where a liquid accommodating container includes a partition wall in which a communication section between a negative-pressure generating member accommodating chamber and a liquid accommodating chamber is formed, and the negative-pressure generating member accommodating chamber and the liquid accommodating chamber are partitioned and formed by the partition wall, wherein a negative-pressure generating member is inserted into the negative-pressure generating member accommodating chamber in the liquid accommodating container, the negative-pressure generating member being formed as matched in shape to the negative-pressure generating member accommodating chamber and as having a size larger than an inner dimension thereof in the perpendicular direction to the partition wall, comprising:

a first rotation step of, upon inserting the negative-pressure generating member into the negative-pressure generating member accommodating chamber by using a front end of a surface of the negative-pressure generating member making contact with a support member provided on the surface opposing the partition wall at the inserting as a supporting point, rotating the negative-pressure generating member by a predetermined angle in such a manner that a first surface of the negative-pressure generating member making contact with the partition wall is inserted into the negative-pressure generating member accommodating chamber;

a first insert step of inserting the negative-pressure generating member into the negative-pressure generating member accommodating chamber while retaining the rotated angle in the first rotation step;

a second rotation step of, in a state where the negative-pressure generating member is inserted in the insert step, rotating the negative-pressure generating member by the same angle with that in the first step in a reverse direction to the direction in the first rotation step by using a rear end of the first surface of the negative-pressure generating member making contact with an end of the partition wall at the inserting as a supporting point; and a second insert step of contacting a front surface of the negative-pressure generating member in the insert direction after the second rotation step with a bottom surface of the negative-pressure generating member accommodating chamber, wherein rotation of the negative-pressure generating member is performed by pressing a top surface of the negative-pressure generating member by an insert member.

2. An insert method according to claim 1, wherein the support member includes a negative-pressure generating member introduction guide for determining a position of the negative-pressure generating member to the negative-pressure generating member accommodating chamber and introducing the negative-pressure generating member into the negative-pressure generating member accommodating chamber.

3. An insert method where a liquid accommodating container includes a partition wall in which a communication section between a negative-pressure generating member accommodating chamber and a liquid accommodating chamber is formed, and the negative-pressure generating member accommodating chamber and the liquid accommodating chamber are partitioned and formed by the partition wall, wherein a negative-pressure generating member is inserted into the negative-pressure generating member accommodating chamber in the liquid accommodating container, the negative-pressure generating member being formed as matched in shape to the negative-pressure generating member accommodating chamber and as having a size larger than an inner dimension thereof in the perpendicular direction to the partition wall, comprising:

a first rotation step of, upon inserting the negative-pressure generating member into the negative-pressure generating member accommodating chamber by using a front end of a surface of the negative-pressure generating member making contact with a support member provided on the surface opposing the partition wall at the inserting as a supporting point, rotating the negative-pressure generating member by a predetermined angle in such a manner that a first surface of the negative-pressure generating member making contact with the partition wall is inserted into the negative-pressure generating member accommodating chamber;

an insert step of inserting the negative-pressure generating member into the negative-pressure generating member accommodating chamber in a state in which the negative-pressure generating member is inclined with respect to the surface opposing the partition wall by the first rotation step; and a second rotation step of, in a state where the negative-pressure generating member is inserted in the insert step, rotating the negative-pressure generating member in a reverse direction to the direction in the first rotation step by using a rear end of the first surface of the negative-pressure generating member making contact with an end of the partition wall at the inserting as a supporting point, wherein rotation of the negative-pressure generating member is performed by pressing a top surface of the negative-pressure generating member by an insert member.

4. An insert method according to claim 3, further comprising:

another insert step of contacting a front surface of the negative-pressure generating member in the insert direction with a bottom surface of the negative-pressure generating member accommodating chamber.

5. An insert method according to claim 3, wherein the partition wall is contacted with the first surface of the negative-pressure generating member by rotating the negative-pressure generating member in the first rotation step.

6. An insert method according to claim 3, wherein the supporting point is provided on a surface of the support member, and wherein the surface of the support member is different from any surface of the liquid accommodating container.

7. An insert method according to claim 6, wherein the surface of the support member is comprised of an introduction guide for inserting the negative-pressure generating member to the negative-pressure generating member accommodating chamber.

8. An insert method according to claim 3, further comprising:

pressing, when inserting, the negative-pressure generating member in a direction that is perpendicular to a undersurface of the negative-pressure generating member accommodating chamber.

9. An insert method according to claim 1, wherein an atmospheric introduction groove for introducing air into the liquid accommodating chamber is also formed in the partition wall.

* * * * *